United States Patent [19]

Vork

[11] Patent Number: 4,789,131

[45] Date of Patent: Dec. 6, 1988

[54] PILOT VALVE

[75] Inventor: William D. Vork, Edina, Minn.

[73] Assignee: Graco Inc., Minneapolis, Minn.

[21] Appl. No.: 94,683

[22] Filed: Sep. 9, 1987

[51] Int. Cl.[4] ..... F16K 31/124

[52] U.S. Cl. ..... 251/28; 91/404; 251/77; 251/63.4

[58] Field of Search ..... 91/395, 404; 251/25, 251/77, 79, 80, 73, 74, 63.4, 28

[56] References Cited

U.S. PATENT DOCUMENTS

| | | | |
|---|---|---|---|
| 1,373,599 | 4/1921 | Clark | 251/63.4 |
| 2,476,378 | 7/1949 | Majneri | 251/63.4 |
| 2,576,554 | 11/1951 | Ashton | 91/404 |
| 2,653,626 | 9/1953 | Finlayson | 251/28 |
| 3,029,061 | 4/1962 | Hoxworth | 251/63.4 |
| 3,087,510 | 4/1963 | Normand, Jr. | 251/77 |
| 3,170,487 | 2/1965 | Julifs et al. | 251/25 |
| 3,219,056 | 11/1965 | Dyson | 251/63.4 |
| 3,282,294 | 11/1966 | Corniello | 137/625.6 |
| 3,385,166 | 5/1968 | Kroffke | 137/625.6 |
| 3,874,406 | 4/1975 | Von Loewis | 251/77 |

*Primary Examiner*—George L. Walton
*Attorney, Agent, or Firm*—Douglas B. Farrow

[57] ABSTRACT

A pilot valve assembly is provided which substantially eliminates stalling in air motors. The pilot valve assembly is located on one end over an air piston such that when the air piston hits the trip rod, the trip rod compresses a trip spring which is in turn compressed until the load of the force stored in this spring is sufficient to overcome the inlet air pressurizing the opposite side of the pilot valve and the main spring which also pre-loads the pilot valve. At this point, air is allowed to pass through the open pilot valve, allowing a spool valve to switch over and reverse the direction of the motor.

2 Claims, 1 Drawing Sheet

PILOT VALVE

BACKGROUND OF THE INVENTION

Valving and switch-over arrangements for air motors have been known and used for many years. Such arrangements are shown in U.S. Pat. Nos. 4,029,442; 4,035,109 and 4,166,410. Such valves are less than perfect at times, however, and under certain conditions can lead to the air motor stalling.

It is therefore an object of this invention to provide a valving mechanism for air motors which provides increased performance which substantially eliminates stalling and yet is easily manufactured and adopted to current designs.

SUMMARY OF THE INVENTION

A pilot valve assembly is provided at both ends of an air motor and has a trip rod extending into the cylinder for contact by the piston. The pilot valve itself is urged into the seated position both by a spring and by compressed air from an inlet which leads from the four-way spool valve. When the trip rod is contacted by the air piston, it is pushed upwardly, compressing a trip spring located within the pilot valve until the force generated is sufficient to lift the pilot valve off the seat. This arrangement provides relatively quick exhaust action with a delayed closing which thus serves to eliminate stalling.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a schematic view of the instant invention.

DESCRIPTION OF THE PREFERRED EMBODIMENT

Figure 1:
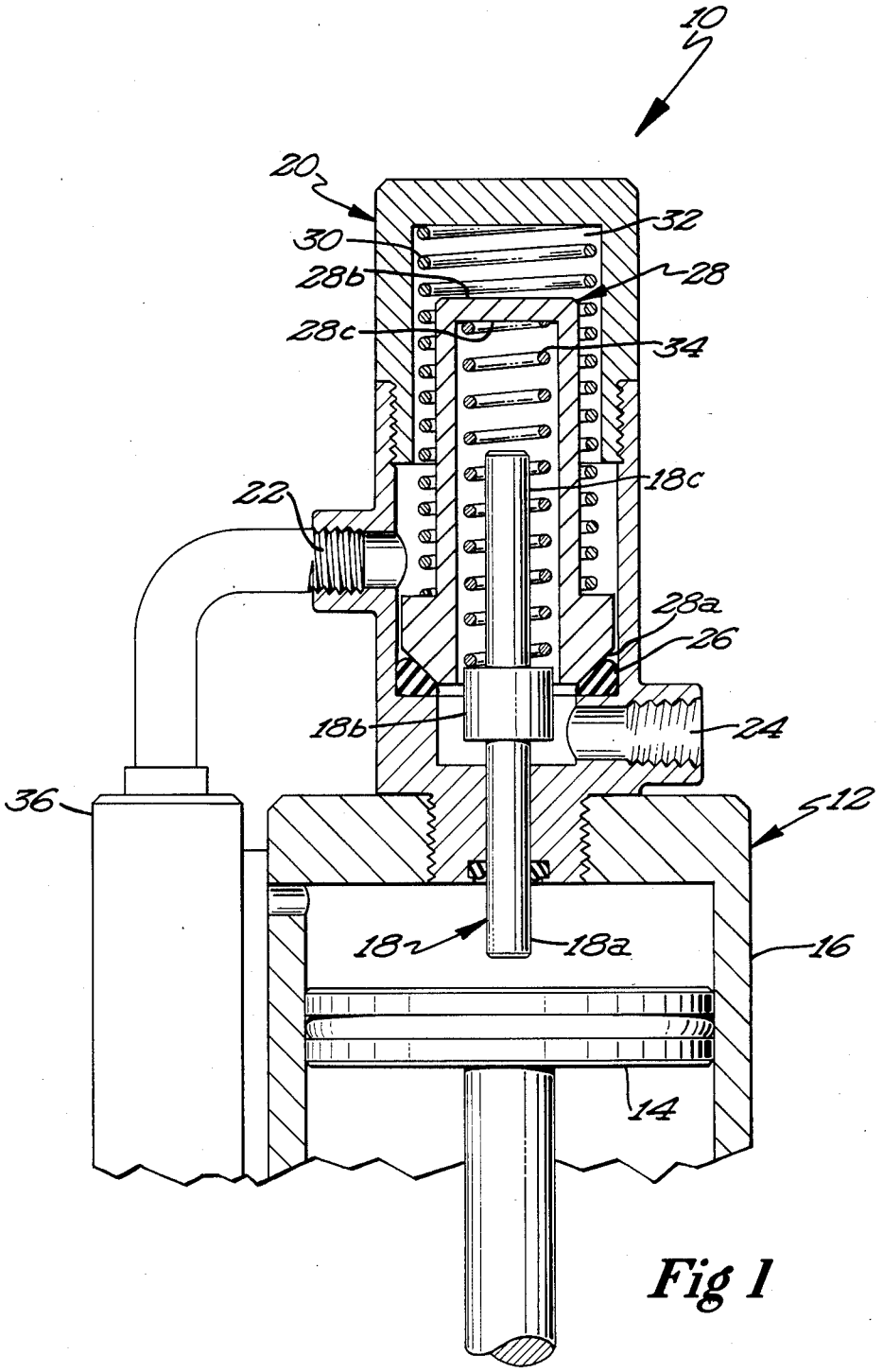

The instant invention is designed for use in air-operated fluid pumps such as that shown in U.S. Pat. Nos. 4,029,442; 4,035,109 and 4,166,410, the contents of which are hereby incorporated by reference. The pilot valve assembly of the instant invention, generally designated 10, is designed for mounting on each end of an air motor 12 having a piston 14 located inside an air cylinder 16. A trip rod 18 has a first end 18A which extends into air cylinder 16, a collar 18B in the middle of trip rod 18 and a valve end 18C. A valve body 20 is provided with an inlet passage 22 and an exhaust passage 24. Valve body 20 also has a seat. Pilot valve 28 is slideably located in valve body 20 and is provided with a seating area 28A which seats upon valve seat 26. Seating area 28A is biased against valve seat 26 by means of a main spring 30. Pilot valve 28 is also biased against seat 26 by the compressed air which fills chamber 32 over the upper side 28B of pilot valve 28. A trip spring 34 is located on the under side 28C of pilot valve 28 and serves to bias trip rod 18 downwardly by acting against collar 18B.

Operation of the device is quite simple. The device 10 as shown in FIG. 1 is in the closed position. When air piston 14 moves upwardly, it contacts trip rod 18 which moves upwardly, compressing trip spring 34. When trip spring 34 is compressed a sufficient distance to exceed the pre-load force (desirably about three pounds) of the main spring 30, plus the force of the air pressure on the pilot valve 28, the pilot valve 28 is lifted off of seat 26, allowing the air to escape from spool valve 36 through inlet 22 and out exhaust port 24. As the valve 28 unseats, the pressure in chamber 32 drops quickly, allowing pilot valve 28 to open quickly under the energy stored in trip spring 34.

Upon this release, the four-way spool valve changes the direction of the air piston 14. The pilot valve 28 is held open by the trip spring 34 until the four-way spool valve sends air pressure to the other side of the air piston.

It is contemplated that various changes and modifications may be made to the pilot valve without departing from the spirit and scope of the invention as defined by the following claims.

What is claimed is:

1. A pilot valve assembly in combination with an air-operated pump having a piston, said assembly comprising:

a housing having an inlet, an outlet a cap attached to an upper portion of the housing and and a seat;

a pilot valve member slideably mounted in said housing to selectively isolate said inlet and said outlet and said pilot valve member comprising a seating area, an exterior surface having a flange located in the housing and an interior surface forming a cavity therein with a closed upper end having an upper contact face, said housing comprising a chamber connected to said inlet over said valve member exterior surface whereby compressed air in said chamber assists in biasing said valve member seating area against said seat;

a trip rod located at least partially in said cavity;

a main spring surrounding said exterior surface and mounted between said flange and said cap and biasing said pilot valve member seating area against said seat; and a trip spring located in said cavity between said trip rod and said upperface and biasing said trip rod toward said piston and away from said pilot valve member, said trip rod being positioned so as to contact said upper contact face upon compression of said trip spring due to contact of said trip rod by said piston.

2. The pilot valve assembly of claim 1 further comprising a four-way spool valve connected to said inlet.

* * * * *